United States Patent [19]

Hunt et al.

[11] 4,371,157

[45] Feb. 1, 1983

[54] COMPACT ENVELOPE HANDLING DEVICE

[75] Inventors: Ronald E. Hunt, Georgetown; William M. Jenkins, Austin, both of Tex.

[73] Assignee: International Business Machines Corporation, Armonk, N.Y.

[21] Appl. No.: 219,684

[22] Filed: Dec. 24, 1980

[51] Int. Cl.[3] ..... B65H 5/00

[52] U.S. Cl. ..... 271/2; 271/6; 271/7; 271/113; 271/185; 271/245

[58] Field of Search ..... 271/2, 6, 7, 113, 225, 271/245, 184, 185, 186

[56] References Cited

U.S. PATENT DOCUMENTS

| | | | |
|---|---|---|---|
| 3,008,709 | 11/1961 | Buslik | 271/113 X |
| 3,758,104 | 9/1973 | Daily | 271/185 |
| 4,047,712 | 9/1977 | Burkhardt | 271/185 X |
| 4,113,244 | 9/1978 | Ruenzi | 271/186 X |

*Primary Examiner*—Richard A. Schacher
*Attorney, Agent, or Firm*—A. P. Bryant

[57] ABSTRACT

Disclosed is apparatus attachable to a printer for feeding and delivering envelopes. Storage means for fresh and printed envelopes which are disposed perpendicularly to the orientation of print direction. A reduction in overall size required in a mechanism for handling feed and delivery of both cut sheets and envelopes is achieved.

7 Claims, 4 Drawing Figures

COMPACT ENVELOPE HANDLING DEVICE

DESCRIPTION

1. Technical Field

This invention relates to paper handling mechanisms attachable to high speed printers or the like. More particularly it relates to the envelope feed and delivery mechanism in a combination cut sheet and envelope handling attachment for high speed printers.

2. Background Art

Paper handling mechanisms for high speed output printers are of critical importance to the throughput obtainable in word processing systems. The prior art is replete with the results of attempts to secure reliable document feed and delivery apparatus. It is today even more important that the physical bulk of apparatus for this purpose be reduced in order to have a compact device so that it may fit in many environments having limited available space. Some of the prior art techniques used in changing a direction of document include *IBM Technical Disclosure Bulletin,* Volume 14, No. 7, December, 1971, page 2179 entitled "Document Cornering Mechanism". The mechanism disclosed is particularly suited for handling hand-fed documents. It does, however, provide for pivoting a document about a point using an urge roll and ball to drive the document about the pivot point. A combination drive and aligner roll such as that described in U.S. Pat. No. 3,148,877 is included.

U.S. Pat. No. 3,758,104 relates to apparatus for turning a carton blank 90° to facilitate feeding the blank into a receptacle at the proper orientation for further processing. The turning means includes forming two nips for engaging and turning the blank. An inward disc is mounted on a shaft above the conveyor and is freewheeling with respect to the shaft in order to form a first blank engaging nip with the conveyor. An outward disc is secured to the shaft and forms a second blank engaging nip with a third disc freely mounted beneath the outward disc on a shaft which drives an end roll of the conveyor. Driving the outward disc at a speed greater than that obtainable by the inward disc causes the carton blank to travel through 90°.

U.S. Pat. No. 3,806,115 relates to turning envelopes in a mail sorting operation 90° in parallel planes.

U.S. Pat. No. 282,014 discloses a rotary separating mechanism moving in the plane of the feed table for turning the top sheet to release it from restraint means prior to feeding. This mechanism includes a vertical pivot resting on the paper stack. The pivot post is connected to arms terminating in rubbing pads in contact with the stack so that when the device is rotated, the pads rub against the paper and drive it around the pivot point.

U.S. Pat. No. 2,243,557 discloses means for rotating sheets 90° between ruling operations. That is, ruled markings are placed on a sheet and the sheet is then rotated 90° and rulings again printed thereon.

U.S. Pat. No. 4,067,566 discloses method and apparatus for automatically delivering envelopes serially at a controlled rate from a stack of such envelopes into a programmable printing machine. Means are included for automatically feeding back into the stack the printed envelopes. There the envelopes are stacked with their long edge parallel to the platen of the printer, and only one type of document may be fed with this apparatus at a given time.

The IBM 6640 Document Printer is a large, standalone unit which includes means for feeding and delivering both cut sheets and envelopes to a common print station. The envelope path includes means for changing the direction of travel 90°.

The present invention provides, in a relatively small attachable device already able to feed and deliver cut sheets, means for feeding and delivering envelopes to and from the same print station. The advantage of compact size is achieved primarily through arranging the envelope input and output hoppers so that the envelopes are oriented with their long edges perpendicular to the print orientation of the machine.

DISCLOSURE OF INVENTION

There is provided apparatus attachable to a high speed printer or the like, means for storing adjacent to the cut sheet hoppers a supply of envelopes disposed perpendicularly to the orientation of print. The uppermost envelope is pivoted until it has been turned 90° relative to the stack. The feed path takes the envelope to the print station and then to an output hopper located directly above the input hopper. Means are provided at the output hopper to engage one edge of the printed envelope and drive it 90° around a pivot before it comes to rest in the output hopper.

BRIEF DESCRIPTION OF THE DRAWINGS

The foregoing and other objects, features, and advantages of the invention will be apparent from the following, more particular description of a preferred embodiment of the invention as illustrated in the accompanying drawings wherein.

BEST MODE FOR CARRYING OUT THE INVENTION

Figure 1:
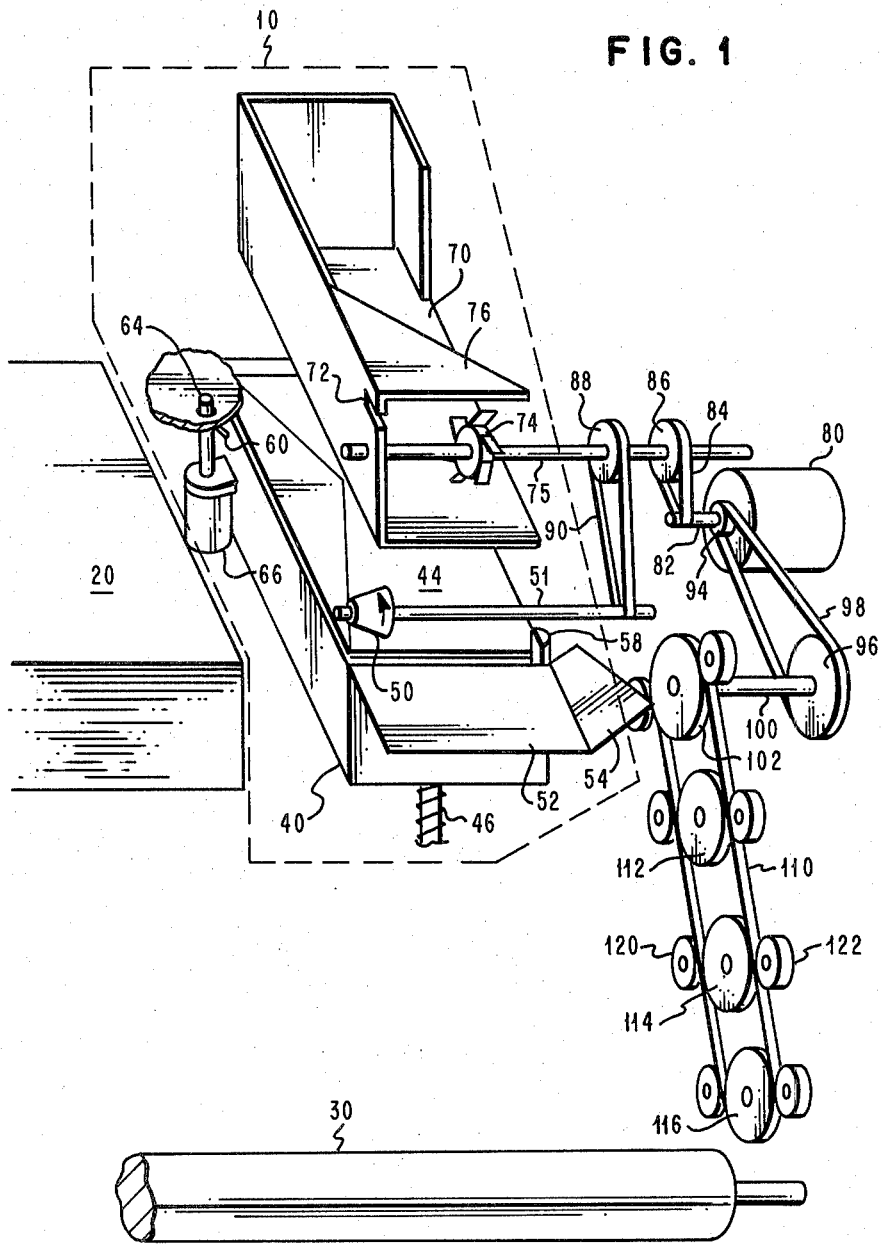
FIG. 1 is a cut away front view of the envelope handling apparatus of the invention.

FIG. 1 shows a cut away view of the apparatus of the present invention including the relative positions of the envelope handling means 10 and a stack 20 of cut sheets to be fed to and around platen 30.

Envelope handling apparatus 10 includes an input hopper 40 for holding stacked envelopes 44 to be printed. Hopper 40 is provided with spring 46 biased elevator means, not shown, for maintaining stack 44 at the appropriate height for operative engagement with high friction conical feed roller 50. Hopper 40 includes a fed envelope support portion 52. Integral with support portion 52, is upwardly angled guide surface 54. Pivot post 58 is disposed adjacent right front edge of hopper 40 to restrain forward movement of an envelope from the stack 44. Near the left rear corner of hopper 40, along the long side wall, there is located a somewhat resilient, high friction, cylindrical restraint member 60 which is provided to restrain the subsequent envelopes from being fed. Gate 64, connected to solenoid 66, is located adjacent restraint member 60. Gate 64 is provided to prevent the forward rotation of an envelope until desired. Upper restraint 68 prevents envelopes from riding over gate 64.

Output hopper 70 is provided for receiving printed envelopes. The left vertical wall of hopper 70 includes a notch 72 which is provided to engage the leading edge of an envelope and acts as a pivot point as the envelope is rotated counterclockwise, driven by paddle wheel 74 on shaft 75. Upper pressure pad 76 serves as a backup and provides a normal load for paddle wheel 74.

Motor 80 powers both conical feed roller shaft 51 and paddle wheel shaft 75. Motor output shaft 82 rotates endless belt 84 which is trained over pulley 86 on shaft 75. Also located on shaft 75 is pulley 88. Endless belt 90 travels over pulley 88 and shaft 51.

Pulley 94 is also connected to motor output shaft 82 and is drivingly connected to pulley 96 by endless belt 98. Pulley 96 rotates shaft 100 to which pulley 102 is drivingly connected. Endless belt 110 is trained over pulleys 102, 112, 114, and 116, the driving means for guiding an envelope to and from print platen 30. Endless belt 110 engages four pairs of backup rollers 120 and 122 which are rotatably mounted on studs mounted in a frame not shown.

Figure 2:
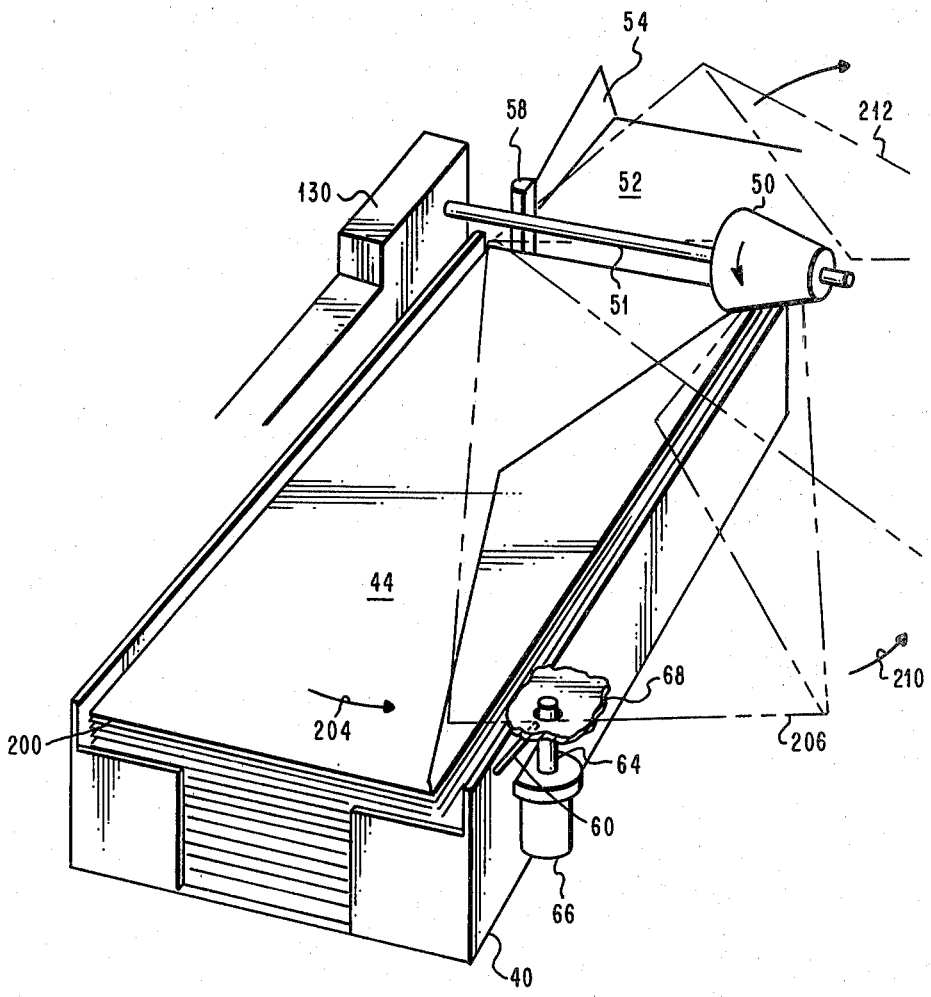
FIG. 2 is a close up, more detailed, diagram from the rear of the envelope feed apparatus illustrating envelope exit from the input hopper.

Refer now to FIG. 2 which is a rear perspective view of an envelope leaving input hopper 40. Envelopes are placed in hopper 40 with their flap sides up and away from the machine frame. In this view a portion 130 of the device frame is shown. Counterclockwise rotation of conical roller 50 drives the uppermost envelope 200 of stack 44 forward against pivot post 58 which restrains further forward motion. Envelope 200 then is driven counterclockwise in the direction indicated by arrow 204 against and up passive restraint 60 to gate 64. The printer to which this document handling apparatus is attached, when ready for an envelope, issues a signal to solenoid 66 to lower gate 64. Similarly, after the appropriate interval required for envelope passage, gate 64 is raised. The technique for controlling solenoid 66 is conventional and is not, per se, a part of the present invention. Envelope 200 passes between restraint 60 and upper restraint 68 to the interim phantom position 206. Continued movement in the direction of arrow 210 takes envelope 200 to the phantom position 212. Continued rotation of conical roller 50 drives envelope 200 across support member 52 and up angled guide surface 54 to the position indicated in phantom position 300 in FIG. 3.

Figure 3:
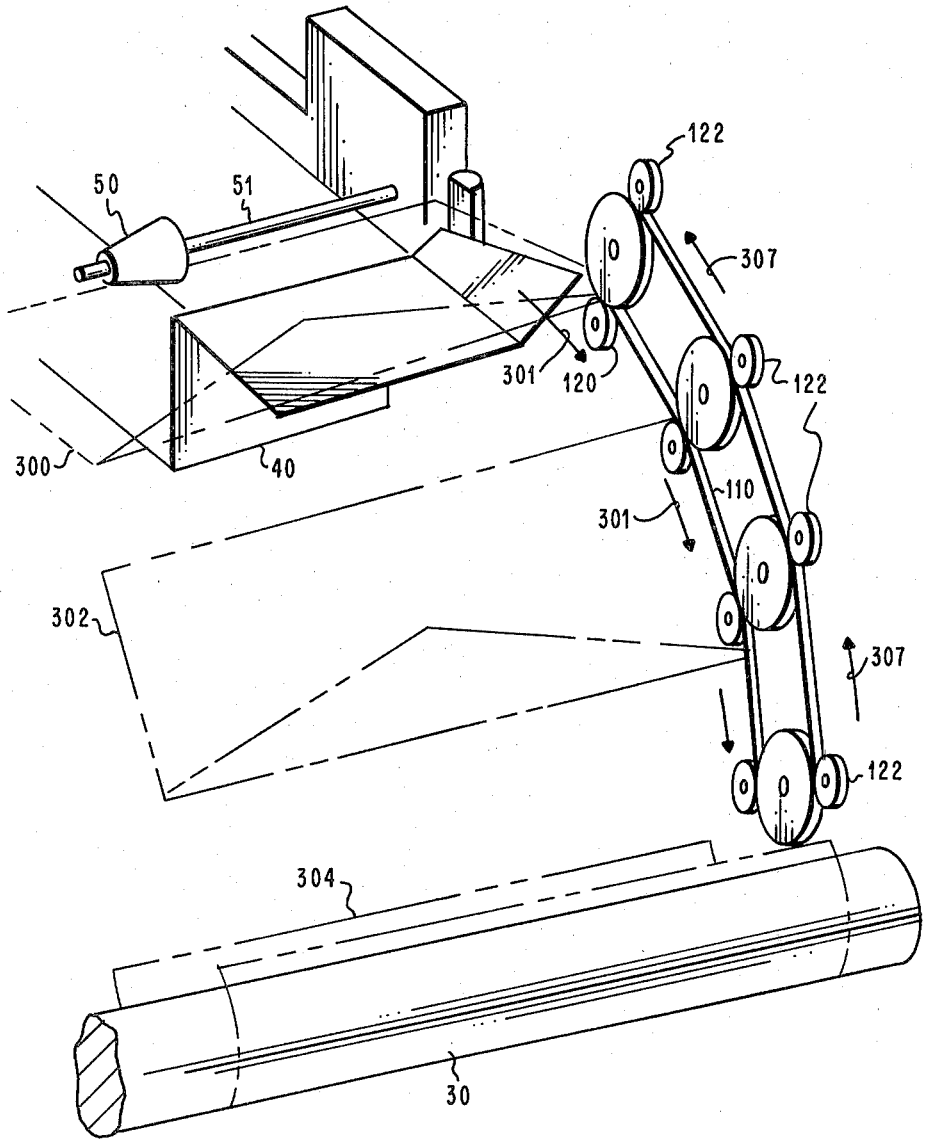
FIG. 3 illustrates an envelope in the feed and delivery path.

FIG. 3 shows envelope 200 after it has rotated 90° to the position shown at 300. An envelope still driven by conical roller 50 enters the feed path represented by arrows 301 between drive belt 110 and the first backup roller 120. The envelope is driven through the location indicated in phantom at 302 to that shown at 304 around platen 30. During printing, motion of the envelope is under control of platen 30 indexing means, not shown.

When printing is completed, the envelope enters the exit path, comprised of drive belt 110 and backup rollers 122. The envelope travels in the direction indicated by arrows 307 toward output hopper 70 (FIG. 1).

Figure 4:
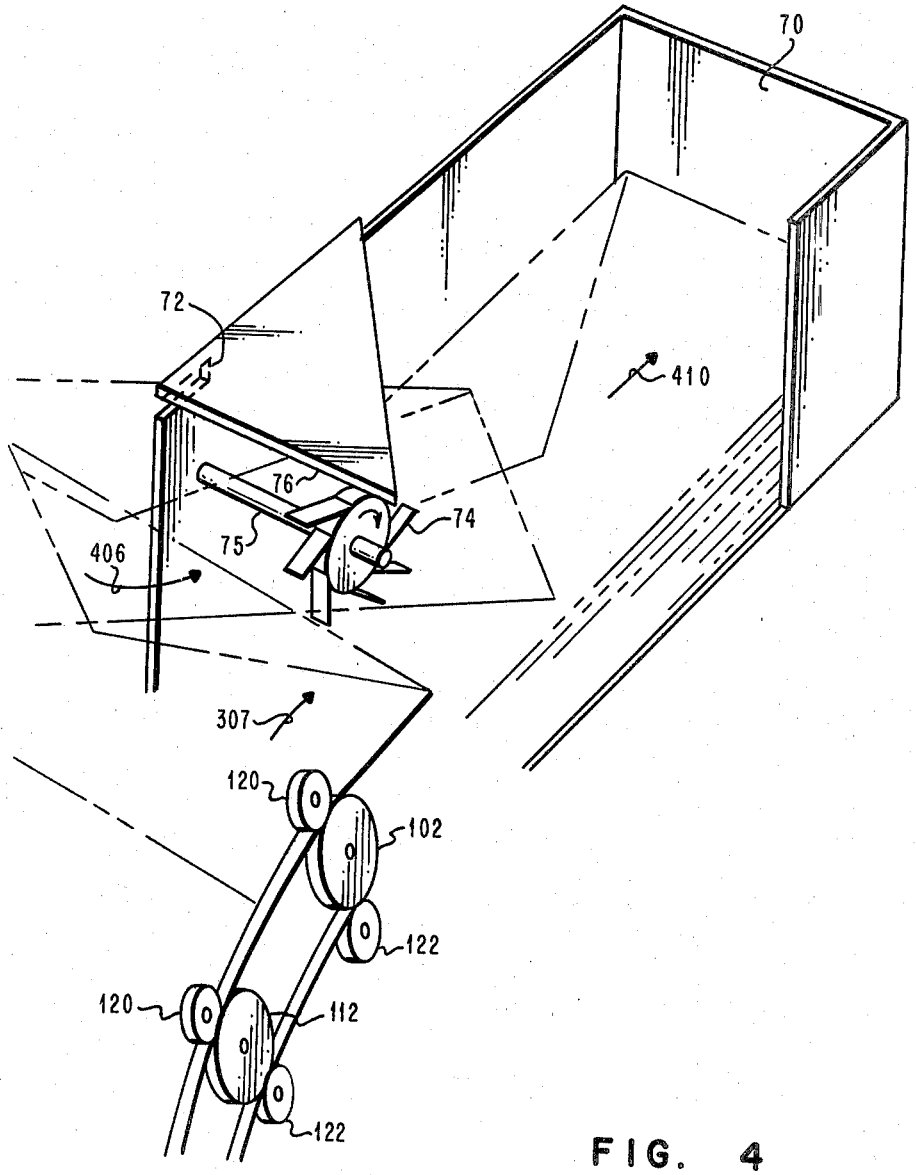
FIG. 4 shows envelope entry into the output hopper.

Refer now to FIG. 4 for a description of the means provided for turning a printed envelope 90° for stacking in the output hopper. Envelope 200 driven in the direction 307 enters notch 72. Paddle wheel 74, rotating clockwise, drives envelope 200 beneath backup plate 76. As continued forward motion is restrained by notch 72, envelope 200 moves counterclockwise in the direction indicated by arrow 406 about the wall of notch 72 until it is moving in the direction of arrow 410 at which time it drops printed side up into hopper 70.

OPERATION OF THE INVENTION

The operation of the automatic envelope handling apparatus of the present invention will be described with reference to FIG. 1. A stack of envelopes to be printed is placed flap side up in hopper 40. The envelopes are placed with their flaps close to passive restraint 60. Upon receipt of a feed signal from the printer control logic, motor 80 is energized so as to rotate conical roller 50 counterclockwise. The uppermost envelope is urged forward until contact with pivot post 58 prevents further movement in that direction. The envelope pivots counterclockwise about pivot post 58. This motion causes the edge of the envelope farthest from roller 50 to travel up restraint member 60 to solenoid actuated gate 64. Another signal from the printer to solenoid 66 lowers gate 64, thus allowing the first envelope to continue its counterclockwise rotation. The end of the envelope travels beneath upper restraint 68 and over cut sheet shack 20. At the same time, what is (at this point the cycle) the leading edge of the envelope is driven across support member 52 and up inclined guide 54. Movement of the envelope continues under control of roller 50. The first envelope enters the nip formed between drive belt 110 and the uppermost backup roller 120 (FIG. 3). The envelope continues in the path formed by belt 110 and rollers 120 to platen 30. After the first envelope clears the roller 50, the next envelope is driven by roller 50. That second envelope is readied at gate 64. Platen index mechanism (not shown) takes control of the first envelope until printing is complete. The envelope is then driven into the nip formed by belt 110 and the lower most back roller 122. The envelope travels between belt 110 and rollers 122 which path terminates upwardly adjacent the entrance to output envelope hopper 70. The edge of the envelope enters pivot notch 72 and the nip formed by paddle wheel 74 and its normal force applying backup plate 76. Paddle wheel 74 drives the envelope out of engagement with belt 110 and into hopper 70, printed side up.

While certain types of roller and feed means have been described in the preferred embodiment, it is to be understood that changes may be made in form and detail within the scope of our invention.

What is claimed is:

1. Envelope handling apparatus for feeding to and delivering from an operating station comprising:

first hopper means for holding a stack of envelopes in an orientation transverse to that of said operating station;

means for separating the topmost envelope in the stack;

first means for pivoting the separated envelope 90° comprising a first restraint member in the feed direction acting as a pivot point, and an upwardly angled guide surface adjacent said first hopper for guiding the trailing edge, and a gate, operable in response to a feed signal developed by said operating station, adjacent said guide for restraining rotation about said pivot point;

means for feeding the separated envelope past said operating station;

second hopper means disposed directly over said first hopper;

second means; positioned between said operating station and said second hopper means, for pivoting said envelope 90°, and means for conveying said envelope to said second hopper.

2. The apparatus of claim 1 wherein said second means for pivoting for said envelope 90° includes:

means connected to said second hopper for providing a normal load;

a notch in one upright wall of said second hopper, said notch being located beneath the means providing a normal load;

a drive means located beneath said normal load providing means and spaced from the notched wall for engaging a point on one edge of an envelope, exiting said means for conveying to said second hopper, in the notch while the envelope is driven between said driving means and said normal load providing means, whereby continued operation of said driving means moves the envelope 90° about said point engaged in the notch.

3. The apparatus of claims 1 or 2 where said operating station is a highspeed print station.

4. Apparatus for feeding the topmost envelope in a stack of said envelopes in a first hopper past an operating station and delivering said envelope to a second hopper positioned directly above said first hopper, both said hoppers being arranged so that the envelopes are disposed perpendicularly to the orientation of the operating station including:

restraint means adjacent said first hopper for restraining envelopes in the feed direction;

means for driving said envelope counterclockwise about a point coincident with said restraint means;

selectively operable gate means adjacent said first hopper;

means located between said hoppers and the operating station for feeding envelopes to and from said operating station;

stop means in the exit path adjacent the entry area of the second hopper;

pivot means located at the entry to said second hopper; and second driving means for urging the envelope counterclockwise about said pivot means and into said second hopper.

5. The apparatus of claim 4 wherein said second driving means is an elastomeric paddle wheel cooperatively associated with a backup plate formed integrally with said second hopper.

6. The apparatus of claims 4 or 5, where said operating station is a printer.

7. For use in combination with a device for feeding and delivering cut sheets, apparatus for delivering to and from a print station envelopes kept at an orientation transverse to that of the print direction, said apparatus being positioned adjacent to said cut sheet handling device and including:

means for storing fresh envelopes;

means for stacking printed envelopes;

an envelope transport path connecting said storing means said print station and said stacking means;

means cooperating with said storing means for causing an envelope to rotate a quarter turn as it exits said storing means and enters said transport path; and means located adjacent said stacking means for engaging a printed envelope as it exits said transport path and causing it to rotate a quarter turn as it enters said stacking means.

* * * * *